US007854134B2

(12) United States Patent
Nishimura et al.

(10) Patent No.: US 7,854,134 B2
(45) Date of Patent: Dec. 21, 2010

(54) AIR CONDITIONER

(75) Inventors: Tadafumi Nishimura, Osaka (JP); Shinichi Kasahara, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 378 days.

(21) Appl. No.: 12/097,177

(22) PCT Filed: Dec. 13, 2006

(86) PCT No.: PCT/JP2006/324807

§ 371 (c)(1),
(2), (4) Date: Jun. 12, 2008

(87) PCT Pub. No.: WO2007/069625

PCT Pub. Date: Dec. 16, 2005

(65) Prior Publication Data

US 2009/0308088 A1 Dec. 17, 2009

(30) Foreign Application Priority Data

Dec. 16, 2005 (JP) ..... 2005-363740

(51) Int. Cl.
*F25B 45/00* (2006.01)
*F25B 27/00* (2006.01)
*F25B 43/02* (2006.01)

(52) U.S. Cl. ..... 62/149; 62/238.6; 62/468

(58) Field of Classification Search ..... 62/149, 62/238.6, 468, 510, 127, 498
See application file for complete search history.

(56) References Cited

U.S. PATENT DOCUMENTS 5,966,947 A 10/1999 Kamimura et al.

FOREIGN PATENT DOCUMENTS

| | | | |
|---|---|---|---|
| JP | 03-11278 | A | 1/1991 |
| JP | 04-148170 | A | 5/1992 |
| JP | H07-021374 | B2 | 3/1995 |
| JP | H08-005169 | A | 1/1996 |
| JP | 10-170108 | A | 6/1998 |
| JP | H11-211292 | A | 8/1999 |
| JP | 2002-277114 | A | 9/2002 |
| JP | 2004-218849 | A | 8/2004 |
| JP | 2005-098642 | A | 4/2005 |
| KR | 10-0509833 | B1 | 10/1998 |

OTHER PUBLICATIONS

Japanese Office Communication of corresponding Japanese Application No. 2005-363740 dated Feb. 9, 2010.
Korean Office Action of corresponding Korean Application No. 10-2008-7015053 dated May 25, 2010.

*Primary Examiner*—Chen-Wen Jiang
(74) *Attorney, Agent, or Firm*—Global IP Counselors

(57) ABSTRACT

An air conditioner is provided with a refrigerant circuit and an operation controller. The refrigerant circuit includes a heat source unit, a refrigerant communication pipe, an expansion mechanism, and a utilization unit. The heat source unit has a compression mechanism and a heat source side heat exchanger. The heat source unit is connected to the refrigerant communication pipe. The utilization unit has a utilization side heat exchanger and is connected to the refrigerant gas communication pipe. The operation controller performs an oil-return operation in advance for returning oil pooled in the refrigerant circuit when a refrigerant quantity judging operation is carried out for judging the refrigerant quantity inside the refrigerant circuit.

12 Claims, 4 Drawing Sheets

AIR CONDITIONER

CROSS-REFERENCE TO RELATED APPLICATIONS

This U.S. National stage application claims priority under 35 U.S.C. §119(a) to Japanese Patent Application No. 2005-363740, filed in Japan on Dec. 16, 2005, the entire contents of which are hereby incorporated herein by reference.

TECHNICAL FIELD

The present invention relates to a refrigerant circuit of an air conditioner and an air conditioner provided therewith.

BACKGROUND ART

An example of a conventional refrigerant leak detector of a refrigeration apparatus is disclosed in Japanese Patent Application Publication No. H11-211292. In this refrigerant leak detector, a condensation refrigerant temperature and an evaporative refrigerant temperature are keep at a fixed value by using condensation refrigerant temperature adjustment means and evaporative refrigerant temperature adjustment means, and a refrigerant leak detection operation for detecting refrigerant leaks in a refrigerating cycle is carried out using temperature difference calculation means for comparing output signals of a discharge refrigerant temperature detector and set values and calculating a temperature difference. Therefore, the temperature of the condensation refrigerant that flows through a condenser and the temperature of the evaporative refrigerant that flow through an evaporator are kept at a fixed value, whereby the discharge refrigerant temperature under a suitable refrigerant quantity is set to the set value. The set value and the output signal of the discharge refrigerant temperature detector are compared, a judgment is made that a refrigerant leak has not occurred when the value is less than the set value, and a judgment is made that a refrigerant leak has occurred when the value is higher than the set value.

SUMMARY OF THE INVENTION

Problems that the Invention is to Solve

However, in the technique of Japanese Patent Application Publication No. H11-211292, a method is proposed in which the refrigerant quantity in the refrigerating cycle is predicted while the refrigerant leak detection operation (refrigerant quantity judging operation) is being performed. However, there is a risk that the error in predicting the refrigerant quantity will increase when a large quantity of refrigeration machine oil is left in the pipes and heat exchanger due to the operating state prior to the refrigerant quantity judging operation. A difference is produced in the solubility of the refrigerant in the oil and the error in detecting the refrigerant leakage increases because the temperature and pressure conditions are different when refrigeration machine oil is present outside of the compressor and when refrigeration machine oil is present inside the compressor.

An object of the present invention is to keep refrigeration machine oil distribution conditions inside the cycle uniform in each refrigerant quantity judging operation, and to minimize the error in predicting the refrigerant quantity produced by the difference in the solubility of the refrigerant in the oil.

Means of Solving the Problems

The air conditioner according to a first aspect is provided with a refrigerant circuit and an operation controller. The refrigerant circuit is a circuit that includes a heat source unit, a refrigerant communication pipe, an expansion mechanism, and a utilization unit. The heat source unit has a compression mechanism and a heat source side heat exchanger. The heat source unit is connected to the refrigerant communication pipe. The utilization unit has a utilization side heat exchanger and is connected to the refrigerant communication pipe. The operation controller performs an oil-return operation in advance for returning oil pooled in the refrigerant circuit when a refrigerant quantity judging operation is carried out for judging the refrigerant quantity inside the refrigerant circuit.

In the air conditioner, an oil-return operation that returns oil pooled in the refrigerant circuit is performed in advance when the refrigerant quantity judging operation is carried out. Therefore, in the air conditioner, oil pooled in the refrigerant circuit outside of the compression mechanism is returned and the refrigeration machine oil distribution conditions inside the refrigerant circuit can be kept uniform. The detection error caused by the difference in the solubility of the refrigerant in the oil can accordingly be reduced to the extent possible prior to the refrigerant quantity judging operation. A more precise refrigerant quantity judging operation can thereby be performed.

The air conditioner according to a second aspect is the air conditioner according to the first aspect, wherein the oil-return operation is an operation for controlling the refrigerant that flows through the refrigerant circuit so that the refrigerant flows inside the pipes at or above a prescribed rate.

In the air conditioner, the oil-return operation is an operation for controlling the rate at which the refrigerant flows inside the pipes so as to achieve a prescribed flow rate or higher. Therefore, the oil pooled in the refrigerant circuit can be reliably returned to the compression mechanism. A more precise refrigerant quantity judging operation can accordingly be performed.

The air conditioner according to a third aspect is the air conditioner according to the first or second aspect, wherein a plurality of the heat source units is present.

In the air conditioner, a plurality of heat source units is present. Therefore, the lifespan of the entire system can be extended without placing a load exclusively on a single unit even during low-load operation because the heat source units in the system can be placed in a rotation of fixed intervals of time.

The air conditioner according to a fourth aspect is the air conditioner according to any of the first to third aspects, wherein the compression mechanism has a plurality of compressors.

In the air conditioner, the compression mechanism has a plurality of compressors. Therefore, all of the heat source units can be continuously operated and the pooling of oil in the refrigerant circuit can be prevented to the extent possible even when the operating load of the utilization unit has been reduced because the capacity of the compression mechanism can be varied by controlling the number of compressors. The remaining compressors can handle the load even if one of the compressors malfunctions. For this reason, a complete stoppage of the air conditioner can be avoided.

The air conditioner according to a fifth aspect is the air conditioner according to the fourth aspect, wherein the operation controller operates at least one unit among the plurality of compressors in the compression mechanism when an oil-return operation is performed.

In the air conditioner, the oil-return operation is an operation in which at least one of the compressors among the plurality of compressors is driven when a plurality of compressors is present. Therefore, energy consumption can be reduced because the oil-return operation is carried out by driving only a portion of the compressors.

EFFECT OF THE INVENTION

In the air conditioner according to the first aspect, oil pooled in the refrigerant circuit outside of the compression mechanism is returned and the refrigeration machine oil distribution conditions inside the refrigerant circuit can be kept uniform. The detection error caused by the difference in the solubility of the refrigerant in the oil can accordingly be reduced to the extent possible prior to the refrigerant quantity judging operation. A more precise refrigerant quantity judging operation can thereby be performed.

In the air conditioner according to the second aspect, oil that has pooled in the refrigerant circuit can be reliably returned to the compression mechanism. The refrigerant quantity judging operation can accordingly be carried out with greater precision.

In the air conditioner according to the third aspect, the lifespan of the entire system can be extended without placing the load exclusively on a single unit even during low-load operation because the heat source units in the system can be placed in a rotation of fixed intervals of time.

In the air conditioner according to the fourth aspect, all of the heat source units can be operated continuously and the pooling of oil in the refrigerant circuit can be prevented to the extent possible even when the operating load of the utilization units is low, because the capacity of the compression mechanism can be varied by controlling the number of compressors. The remaining compressors can handle the load even if one of the compressors malfunctions. For this reason, a complete stoppage of the air conditioner can be avoided.

In the air conditioner according to the fifth aspect, energy consumption can be reduced because the oil-return operation is carried out by driving only a portion of the compressors.

BRIEF DESCRIPTION OF THE DRAWINGS

DETAILED DESCRIPTION OF THE INVENTION (1) Configuration of the Air Conditioner FIG. 1 shows a schematic diagram of refrigerant circuit of an air conditioner 1 related to a first embodiment of the present invention. The air conditioner 1 is used for conditioning the air of a building or the like, and has a configuration in which a plurality (three, in the present embodiment) of air-cooled heat source units 2*a* to 2*c* and numerous utilization units 3*a*, 3*b*, . . . are connected in parallel to a liquid refrigerant communication pipe 4 and a gas refrigerant communication pipe 5, respectively. In this case, only two utilization units 3*a* and 3*b* are shown. The plurality of heat source units 2*a* to 2*c* are provided with compression mechanisms 21*a* to 21*c* that each have single variable-capacity compressors 22*a* to 22*c* and a plurality (two, in the present embodiment) fixed-capacity compressors 27*a* to 27*c*, and 28*a* to 28*c*.

Figure 1:
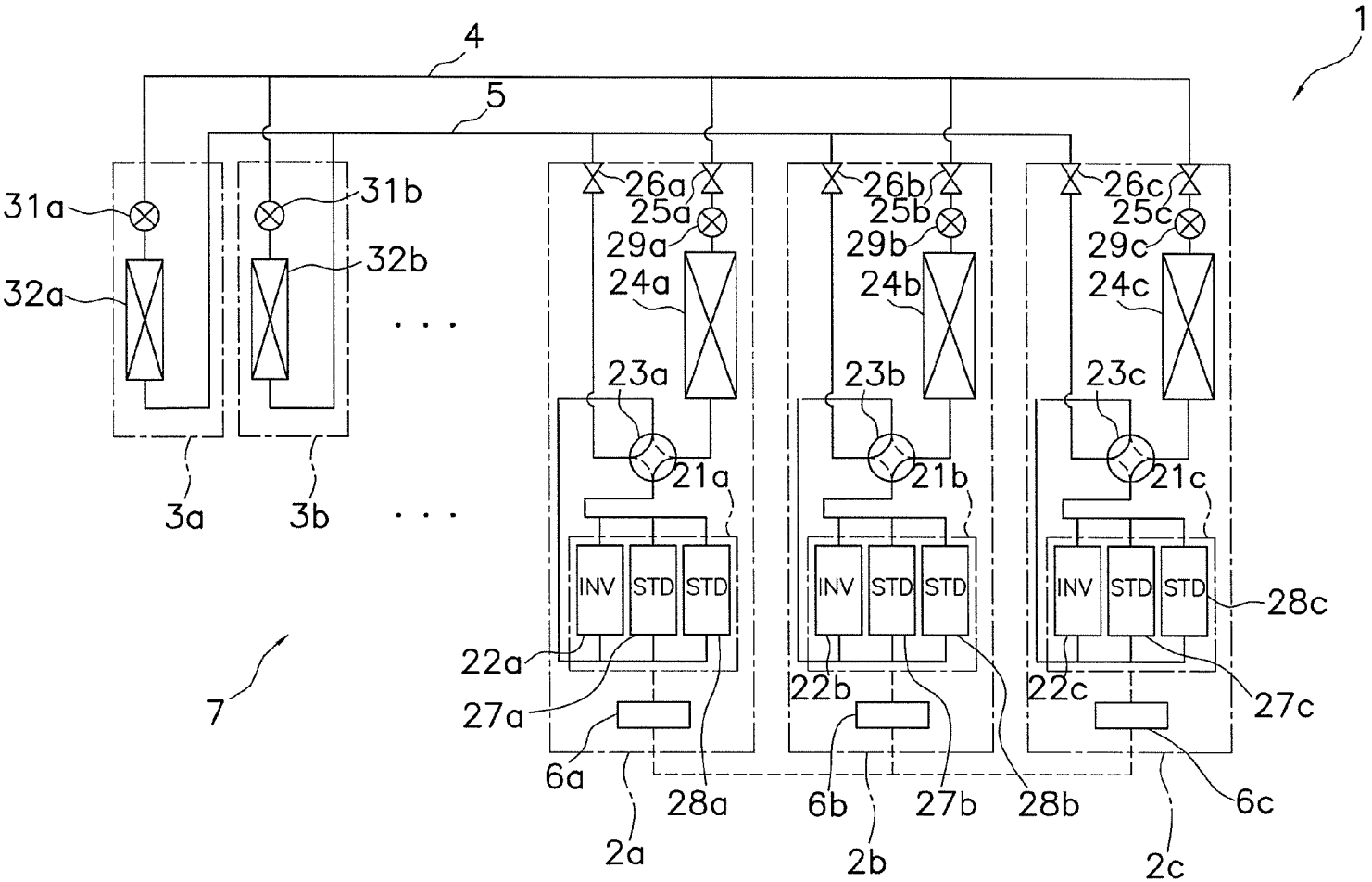
FIG. 1 is a schematic diagram of a refrigerant circuit of an air conditioner related to an embodiment of the present invention.

The utilization units 3*a*, 3*b*, . . . are mainly composed of utilization side expansion valves 31*a*, 31*b*, . . . , utilization side heat exchangers 32*a*, 32*b*, . . . , and pipes that connect thereto, respectively. In the present embodiment, the utilization side expansion valves 31*a*, 31*b*, . . . are electrically driven expansion valves connected to the liquid refrigerant communication pipe 4 side (hereinafter referred to as a liquid side) of the utilization side heat exchangers 32*a*, 32*b*, . . . in order to adjust the refrigerant pressure, adjust the refrigerant flow rate, and perform other operations. In the present embodiment, the utilization side heat exchangers 32*a*, 32*b*, . . . are cross-fin tube heat exchangers and are devices for exchanging heat with indoor air. In the present embodiment, the utilization units 3*a*, 3*b*, . . . are provided with a indoor fan (not shown) for taking indoor air into the units and discharging air, and can exchange heat between the indoor air and the refrigerant that flows through the utilization side heat exchangers 32*a*, 32*b*, . . . .

The heat source units 2*a* to 2*c* are mainly composed of compression mechanisms 21*a* to 21*c*, four-way switching valves 23*a* to 23*c*, heat source side heat exchangers 24*a* to 24*c*, liquid side stop valves 25*a* to 25*c*, gas side stop valves 26*a* to 26*c*, heat source side expansion valves 29*a* to 29*c*, and pipes that connect thereto, respectively. In the present embodiment, the heat source side expansion valves 29*a* to 29*c* are electrically driven expansion valves connected to the liquid refrigerant communication pipe 4 side (hereinafter referred to as a liquid side) of the heat source side expansion valves 29*a* to 29*c* in order to adjust the refrigerant pressure, adjust the refrigerant flow rate, and perform other operations. The compression mechanisms 21*a* to 21*c* have variable-capacity compressors 22*a* to 22*c*, two fixed-capacity compressors 27*a* to 27*c* and 28*a* to 28*c*, and an oil separator (not shown).

The compressors 22*a* to 22*c*, 27*a* to 27*c*, and 28*a* to 28*c* are devices for compressing refrigerant gas that has been taken in, and, in the present embodiment, are composed of a single variable-capacity compressor in which the operating capacity can be changed by inverter control, and two fixed-capacity compressors.

The four-way switching valves 23*a* to 23*c* are valves for switching the direction of the flow of the refrigerant when a switch is made between cooling and heating operations; during cooling operation, are capable of connecting the compression mechanisms 21*a* to 21*c* and the gas refrigerant communication pipe 5 side (hereinafter referred to as gas side) of the heat source side heat exchangers 24*a* to 24*c*, and connecting a suction side of the compressors 21*a* to 21*c* and the gas refrigerant communication pipe 5 (see the solid lines of the four-way switching valves 23*a* to 23*c* of FIG. 1); and, during heating operation, are capable of connecting the outlets of the compression mechanisms 21*a* to 21*c* and the gas refrigerant communication pipe 5, and connecting the suction side of the compression mechanisms 21*a* to 21*c* and the gas side of the heat source side heat exchangers 24*a* to 24*c* (see the broken lines of the four-way switching valves 23*a* to 23*c* of FIG. 1).

In the present embodiment, the heat source side heat exchangers 24*a* to 24*c* are cross-fin tube heat exchangers and are devices for exchanging heat between the refrigerant and outside air as a heat source. In the present embodiment, the heat source units 2*a* to 2*c* are provided with an outdoor fan (not shown) for taking outdoor air into the units and discharging air, and can exchange heat between the outdoor air and the refrigerant that flows through the heat source side heat exchangers 24*a* to 24*c*.

The liquid side stop valves 25*a* to 25*c* and the gas side stop valves 26*a* to 26*c* of the heat source units 2*a* to 2*c* are connected in parallel to the liquid refrigerant communication pipe 4 and the gas refrigerant communication pipe 5. The liquid refrigerant communication pipe 4 is connected between the liquid side of the utilization side heat exchangers 32*a*, 32*b*, . . . of the utilization units 3*a*, 3*b*, . . . and the liquid side of the heat source side heat exchangers 24*a* to 24*c* of the heat source units 2*a* to 2*c*. The gas refrigerant communication pipe 5 is connected between the gas side of the utilization side heat exchangers 32*a*, 32*b*, . . . of the utilization units 3*a*, 3*b*, . . . and the four-way switching valves 23*a* to 23*c* of the heat source units 2*a* to 2*c*.

The air conditioner 1 is further provided with operation controllers 6*a* to 6*c* for performing an oil-return operation in which oil pooled in the refrigerant circuit 7 is returned in advance when a refrigerant quantity judging operation for judging the refrigerant quantity inside the refrigerant circuit 7 is carried out. In the present embodiment, the operation controllers 6*a* to 6*c* are housed in the heat source units 2*a* to 2*c*, the operation control such as that described above can be carried out using only the operation controller (6*a*, in this case) of the heat source unit (2*a*, in this case) that has been set as the parent device. The operation controllers (6*b* and 6*c*, in this case) of the heat source units (2*a* and 2*b*, in this case) set as the other subordinate devices can send the operating state of the compression mechanism and other devices and detection data in the various sensors to the parent operation controller 6*a*, and can function so as to send operation and stop commands to the compression mechanism and other devices via commands from the parent operation controller 6*a*.

(2) Operation of the Air Conditioner

Next, the operation of the air conditioner 1 will be described with reference to FIG. 1.

<Normal Operation>

(Cooling Operation)

The cooling operation will be described first. During the cooling operation, the four-way switching valves 23*a* to 23*c* in all of the heat source units 2*a* to 2*c* are in the state indicated by the solid lines in FIG. 1, i.e., the discharge side of the compression mechanisms 21*a* to 21*c* is connected to the gas side of the heat source side heat exchangers 24*a* to 24*c*, and the suction side of the compression mechanisms 21*a* to 21*c* is connected to the gas side of the utilization side heat exchangers 32*a*, 32*b*, . . . via the gas refrigerant communication pipe 5. Also, the liquid side stop valves 25*a* to 25*c* and the gas side stop valves 26*a* to 26*c* are opened and the opening position of the utilization side expansion valves 31*a*, 31*b*, . . . is adjusted so as to reduce the pressure of the refrigerant.

In this state of the refrigerant circuit 7 of the air conditioner 1, the refrigerant gas is taken into the compression mechanisms 21*a* to 21*c* and compressed when the outdoor fans (not shown) of the heat source units 2*a* to 2*c* and the indoor fans (not shown) and the compression mechanisms 21*a* to 21*c* of the utilization units 3*a*, 3*b*, . . . are started up, whereupon the refrigerant gas is sent to the heat source side heat exchangers 24*a* to 24*c* via the four-way switching valves 23*a* to 23*c*, exchanges heat with the outside air, and is condensed. The condensed refrigerant liquid is merged with the liquid refrigerant communication pipe 4 and sent to the utilization units 3*a*, 3*b*, . . . . The refrigerant fluid sent to the utilization units 3*a*, 3*b*, . . . is reduced in pressure by the utilization side expansion valves 31*a*, 31*b*, . . . , is then subjected to heat exchange with indoor air in the utilization side heat exchangers 32*a*, 32*b*, . . . and is then caused to evaporate. The evaporated refrigerant gas is sent through the gas refrigerant communication pipe 5 to the heat source units 2*a* to 2*c* side. The refrigerant gas that flows through the gas refrigerant communication pipe 5 passes through the four-way switching valves 23*a* to 23*c* of the heat source units 2*a* to 2*c*, and is thereafter taken into the compression mechanisms 21*a* to 21*c* again. The cooling operation is carried out in this manner.

(Heating Operation)

The heating operation will be described next. During the heating operation, the four-way switching valves 23*a* to 23*c* in all of the heat source units 2*a* to 2*c* are in the state indicated by the broken lines in FIG. 1, i.e., the discharge side of the compression mechanisms 21*a* to 21*c* is connected to the gas side of the utilization side heat exchangers 32*a*, 32*b*, . . . via the gas refrigerant communication pipe 5 and the suction side of the compression mechanisms 21*a* to 21*c* is connected to the gas side of the heat source side heat exchangers 24*a* to 24*c*. Also, the liquid side stop valves 25*a* to 25*c* and the gas side stop valves 26*a* to 26*c* are opened and the opening position of the heat source side expansion valves 29*a* to 29*c* is adjusted so as to reduce the pressure of the refrigerant.

In this state of the refrigerant circuit 7 of the air conditioner 1, the refrigerant gas is taken into the compression mechanisms 21*a* to 21*c* and compressed when the outdoor fans (not shown) of the heat source units 2*a* to 2*c* and the indoor fans (not shown) and the compression mechanisms 21*a* to 21*c* of the utilization units 3*a*, 3*b*, . . . are started up, whereupon the refrigerant gas is merged with the gas refrigerant communication pipe 5 via the four-way switching valves 23*a* to 23*c* of the heat source units 2*a* to 2*c* and sent to the utilization units 3*a*, 3*b*, . . . side. The refrigerant gas sent to the utilization units 3*a*, 3*b*, . . . , exchanges heat with the indoor air via the utilization side heat exchangers 32*a*, 32*b*, . . . , and is condensed. The condensed refrigerant is merged with the liquid refrigerant communication pipe 4 via the utilization side expansion valves 31*a*, 31*b*, . . . , and is sent to the heat source units 2*a* to 2*c* side. The refrigerant liquid that flows through the liquid refrigerant communication pipe 4 is made to exchange heat with the outside air via the heat source side heat exchangers 24*a* to 24*c* of the heat source units 2*a* to 2*c*, and is caused to evaporate. The evaporated refrigerant gas is taken into the compression mechanisms 21*a* to 21*c* again via the four-way switching valves 23*a* to 23*c* of the heat source units 2*a* to 2*c*. The heating operation is carried out in this manner.

<Refrigerant Quantity Judging Operation>

Next, the refrigerant quantity judging operation will be described. The refrigerant quantity judging operation includes a refrigerant leakage detection operation and an automatic refrigerant charging operation.

(Refrigerant Leak Detection Operation)

The refrigerant leak detection operation, which is one of the refrigerant quantity judging operation, will described with reference to FIGS. 1 and 2. Here, FIG. 2 is a flowchart of the refrigerant leak detection operation.

As an example, a case will be described in which operation is periodically (e.g., once per month, when load processing is not required in the air conditioning space, or at another time) switched to the refrigerant leak detection operation, which is a refrigerant quantity judging operation, during cooling operation or heating operation in normal operation, whereby detection is performed to determine whether refrigerant inside the refrigerant circuit 7 has leaked to the exterior due to an unknown cause.

First, in step S1, a refrigerant quantity judging preparatory operation is carried out prior to refrigerant leak detection operation. The refrigerant quantity judging preparatory operation will be described later.

Next, in step S2, a judgment is made whether an operation in normal operation such as the cooling operation or the heating operation described above has continued for a fixed length of time (e.g., one month), and the process proceeds to the next step S2 when an operation in normal operation has continued for a fixed length of time.

Figure 2:
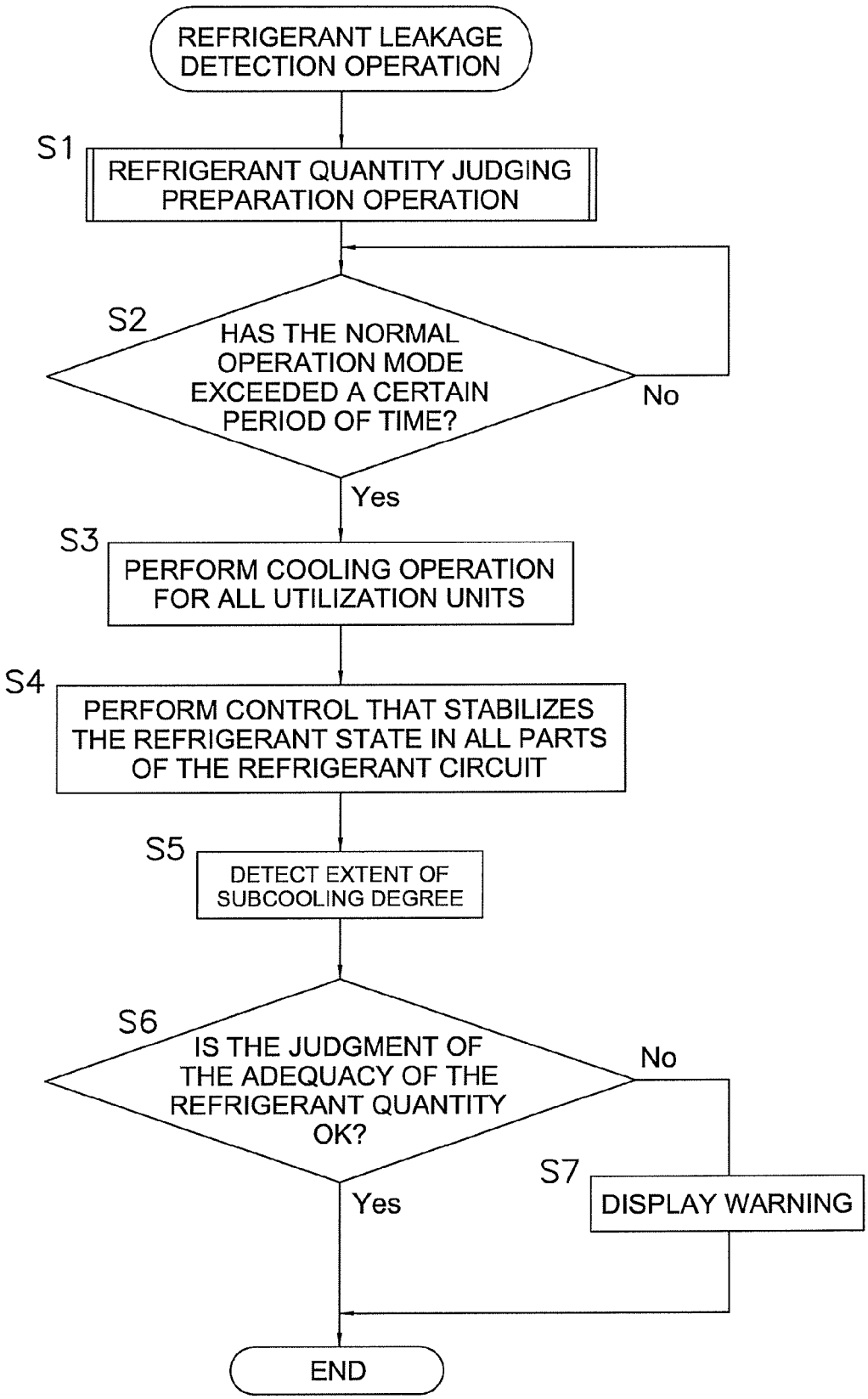
FIG. 2 is a flowchart showing the flow of a refrigerant leak detection operation related to an embodiment of the present invention.

In step S3, when an operation in normal operation has continued for a fixed length of time, the refrigerant circuit 7 enters a state in which the four-way switching valves 23*a* to 23*c* of the heat source units 2*a* to 2*c* are in the state indicated by the solid lines of FIG. 1, the utilization side expansion valves 31*a*, 31*b*, . . . of the utilization units 3*a*, 3*b*, . . . are opened, the compression mechanisms 21*a* to 21*c* and the outdoor fan (not shown) are actuated, and a cooling operation is forcibly carried out in all of the utilization units 3*a*, 3*b*, . . . .

In step S4, condensation pressure control by an outdoor fan, overheating control by the utilization side expansion valves 31*a*, 31*b*, . . . , and evaporation pressure control by the compression mechanisms 21*a* to 21*c* are carried out and the state of the refrigerant that circulates inside the refrigerant circuit 7 is stabilized.

In step S5, subcooling degree is detected at the outlets of the heat source side heat exchangers 24*a* to 24*c*.

In step S6, the subcooling degree detected in step S5 is used to judge whether the refrigerant quantity is adequate. The adequacy of the refrigerant quantity charged in the refrigerant circuit 7 can be judged when subcooling degree is detected in step S5 by using the subcooling degree of the refrigerant at the outlets of the heat source side heat exchangers 24*a* to 24*c* without relation to the mode of the utilization units 3*a*, 3*b*, . . . and the length of the liquid refrigerant communication pipe 4 and gas refrigerant communication pipe 5.

The refrigerant quantity in the heat source side heat exchangers 24*a* to 24*c* is at a low level when the quantity of additional refrigerant charging is low and the required refrigerant quantity is not attained (specifically indicating that the subcooling degree detected in step S5 is less than an subcooling degree that corresponds to the refrigerant quantity that is required for condensation pressure of the heat source side heat exchangers 24*a* to 24*c*). It is judged that there is no refrigerant leakage when the subcooling degree detected in step S5 is substantially the same degree (e.g., the difference between the detected subcooling degree and the target subcooling degree is less than a prescribed degree) as the target subcooling degree, and the refrigerant leak detection operation is ended.

On the other hand, when the subcooling degree detected in step S5 is a degree that is less than the target subcooling degree (e.g., the difference between the detected subcooling degree and the target subcooling degree is a prescribed degree or greater), it is judged that refrigerant leakage has occurred. The process proceeds to the processing of step S7, and a warning that provides notification that refrigerant leakage has been detected is displayed, whereupon the refrigerant leak detection operation is ended.

(Automatic Refrigerant Charging Operation)

Figure 3:
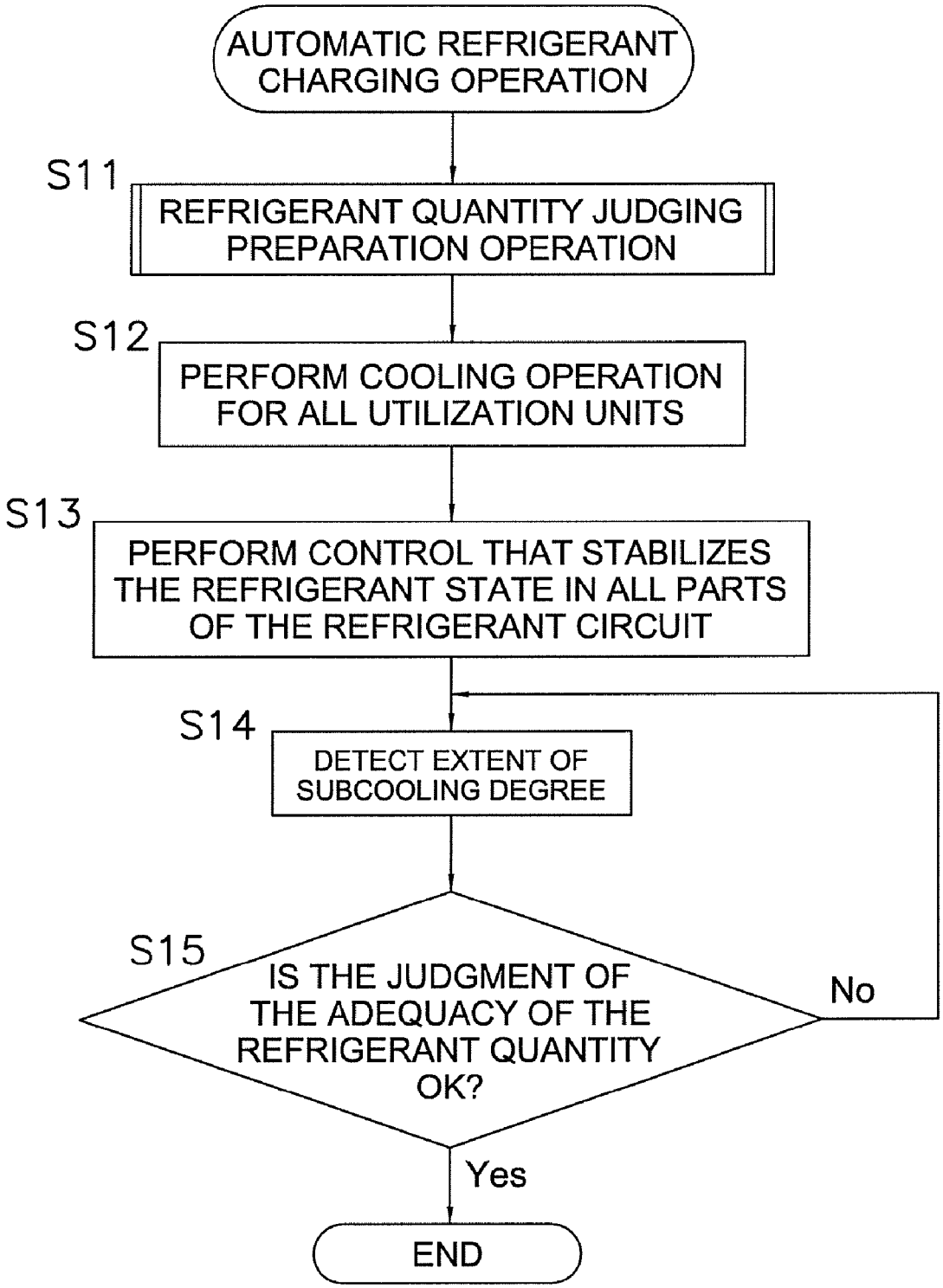
FIG. 3 is a flowchart showing the flow of an automatic refrigerant charging operation related to an embodiment of the present invention.

The automatic refrigerant charging operation as one of the refrigerant quantity judging operation will described with reference to FIGS. 1 and 3. Here, FIG. 3 is a flowchart of the automatic refrigerant charging operation.

As an example, a case will be described in which a refrigerant circuit 7 is assembled at the installation site by connecting the utilization units 3*a*, 3*b*, . . . and the heat source units 2*a* to 2*c* filled with refrigerant in advance are connected by way of the liquid refrigerant communication pipe 4 and gas refrigerant communication pipe 5, and refrigerant that is lacking is thereafter added and charged in the refrigerant circuit 7 in accordance with the length of the liquid refrigerant communication pipe 4 and the gas refrigerant communication pipe 5.

First, the liquid side stop valves 25*a* to 25*c* and the gas side stop valves 26*a* to 26*c* of the heat source units 2*a* to 2*c* are opened, and the refrigerant charged in advance in the heat source units 2*a* to 2*c* is filled into the refrigerant circuit 7.

Next, the person who carries out the refrigerant charging work sends a command to carry out an automatic refrigerant charging operation, which is one of the refrigerant quantity judging operation, via remote control or directly to utilization side controllers (not shown) of the utilization units 3*a*, 3*b*, . . . or to the operation controllers 6*a* to 6*c* of the heat source units 2*a* to 2*c*, whereupon the automatic refrigerant charging operation is carried out in the sequence of step S11 to step S14.

In step S11, the refrigerant quantity judging preparatory operation is carried out prior to the automatic refrigerant charging operation. The refrigerant quantity judging preparatory operation will be described later.

In step S12, when a command has been issued for the automatic refrigerant charging operation to begin, the refrigerant circuit 7 enters a state in which the four-way switching valves 23*a* to 23*c* of the heat source units 2*a* to 2*c* are in the state indicated by the solid lines of FIG. 1, the utilization side expansion valves 31*a*, 31*b*, . . . of the utilization units 3*a*, 3*b*, . . . are opened, the compression mechanisms 21*a* to 21*c* and the outdoor fan (not shown) are actuated, and a cooling operation is forcibly carried out in all of the utilization units 3*a*, 3*b*, . . . .

In step S13, condensation pressure control by an outdoor fan, overheating control by the utilization side expansion valves 31*a*, 31*b*, . . . , and evaporation pressure control by the compression mechanisms 21*a* to 21*c* are carried out and the state of the refrigerant that circulates inside the refrigerant circuit 7 is stabilized.

In step S14, subcooling degree is detected at the outlets of the heat source side heat exchangers 24*a* to 24*c*.

In step S15, the subcooling degree detected in step S14 is used to judge whether the amount of refrigerant is adequate. Specifically, when the subcooling degree detected in step S14 is less than the target subcooling degree and refrigerant charging is not completed, the processing of step S13 and step S14 is repeated until the subcooling degree reaches the target subcooling degree.

The automatic refrigerant charging operation can be carried out when refrigerant is charged during a test operation after onsite installation, and can also be used to perform additional refrigerant charging when the quantity of refrigerant charged in the refrigerant circuit 7 has been reduced due to refrigerant leakage or the like.

<Refrigerant Quantity Judging Preparation Operation>

Figure 4:
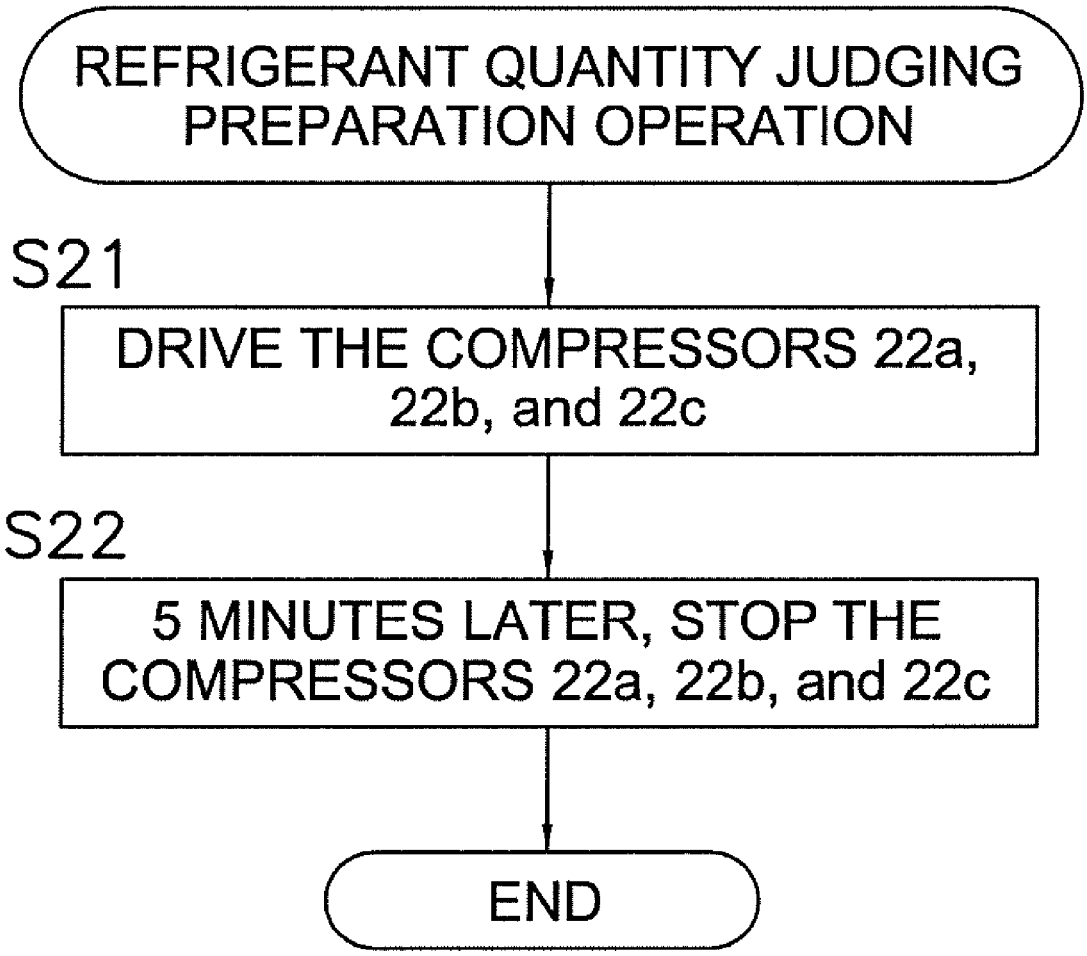
FIG. 4 is a flowchart showing the flow of an oil-return operation related to an embodiment of the present invention.

In the air conditioner 1, an oil-return operation is carried out in advance for returning oil pooled in the refrigerant circuit 7 when the refrigerant quantity judging operation is performed. The oil-return operation is a refrigerant quantity judging preparation operation that is carried out in step S1 in the refrigerant leak detection operation or in step S11 in the automatic refrigerant charging operation. FIG. 4 is a flowchart showing the flow of the oil-return operation.

In step S21, the operation controller 6*a* issues a command to drive a single unit among the compressors (compressors 22*a* to 22*c*, in this case) of the heat source units 2*a* to 2*c*. However, the subordinate operation controllers 6*b* and 6*c* receive the commands of the parent operation controller 6*a* in relation to the heat source units 2*b* and 2*c*, and the subordinate operation controllers 6*b* and 6*c* issue drive commands to the compressor 22*b* and 22*c*. The process proceeds to step S22 when the step S21 is completed. In step S22, the operation controller 6*a* issues a command to stop the compressors 22*a* to 22*c* after they have been driven for 5 minutes. Oil pooled in the refrigerant circuit 7 can thereby be returned to the compression mechanisms 21*a* to 21*c*.

When the oil-return operation is ended, the process proceeds to step S2 in the case that the refrigerant quantity judging operation is a refrigerant leak detection operation or proceeds to step S12 in the case that the refrigerant quantity judging operation is an automatic refrigerant charging operation.

<Characteristics>

(1)

In the air conditioner 1, an oil-return operation is performed in advance for returning oil pooled in the refrigerant circuit 7 when a refrigerant quantity judging operation is carried out. Therefore, in the air conditioner 1, oil pooled in the refrigerant circuit 7 outside of the compressors 22*a* to 22*c*, 27*a* to 27*c*, and 28*a* to 28*c* is returned and the refrigeration machine oil distribution conditions in the refrigerant circuit 7 can be kept uniform. The detection error caused by the solubility of refrigerant in the oil can accordingly be reduced to the extent possible prior to the refrigerant quantity judging operation. A more precise refrigerant quantity judging operation can thereby be carried out.

(2)

In the air conditioner 1, the oil-return operation is an operation for controlling the refrigerant that flows through the refrigerant circuit so that the refrigerant flows inside the pipes at or above a prescribed rate. Therefore, oil pooled in the refrigerant circuit 7 can be reliably returned to the compressors 22*a* to 22*c*, 27*a* to 27*c*, and 28*a* to 28*c*. A more precise refrigerant quantity judging operation can thereby be carried out.

(3)

A plurality of heat source units 2*a* to 2*c* is present in the air conditioner 1. Therefore, the lifespan of the entire system can be extended without placing a load exclusively on a single unit even during low-load operation because the heat source units 2*a* to 2*c* in the system can be placed in a rotation of fixed intervals of time.

(4)

In the air conditioner 1, the compression mechanisms 21*a* to 21*c* have a plurality of compressors 22*a* to 22*c*, 27*a* to 27*c*, and 28*a* to 28*c*. Therefore, the capacity of the compression mechanisms 21*a* to 21*c* can be varied by controlling the number of compressors 22*a* to 22*c*, 27*a* to 27*c*, and 28*a* to 28*c*. Therefore, all of the heat source units 2*a* to 2*c* can be continuously operated and the pooling of oil in the refrigerant circuit 7 can be prevented to the extent possible even when the operating load of the utilization units 3*a*, 3*b*, . . . has been reduced. Also, the remaining compressors can handle the load even if one of the compressors 22*a* to 22*c*, 27*a* to 27*c*, and 28*a* to 28*c* malfunctions. For this reason, a complete stoppage of the air conditioner can be avoided.

(5)

In the air conditioner 1, the oil-return operation is an operation in which at least one of the compressors among the plurality of compressors 22*a* to 22*c*, 27*a* to 27*c*, and 28*a* to 28*c* is driven when a plurality of compressors 22*a* to 22*c*, 27*a* to 27*c*, and 28*a* to 28*c* is present. Therefore, energy consumption can be reduced because the oil-return operation is carried out by driving only a portion of the compressors.

Other Embodiments

An embodiment of the present invention was described above with reference to the drawings, but the specific configuration is not limited to the embodiment, and modifications can be made in a range that does not depart from the spirit of the invention.

(A)

In the embodiment described above, air-cooled heat source units in which outside air is used as a heat source are used as the heat source units 2*a* to 2*c* of the air conditioner 1, but a water-cooled or an ice-storage heat source unit may also be used.

(B)

In the embodiment described above, the air conditioner 1 is capable of switching between a cooling and heating operation, but it is also possible to use a cooling-dedicated air conditioner or an air conditioner that is capable of a simultaneous cooling and heating operation.

(C)

In the embodiment described above, three heat source units 2*a* to 2*c* having the same air conditioning capacity were connected in parallel, but heat source units having different air conditioning capacity may also be connected in parallel, and two or more heat source units without restriction to three units may also be connected in parallel. Also, a plurality of heat source units 2*a* to 2*c* was used, but no limitation is imposed by a plurality of units, and a single unit may be used.

(D)

In the embodiment described above, operation controllers 6*a* to 6*c* are housed in the heat source units 2*a* to 2*c*, but it is possible to have a single operation controller as the entire air conditioner.

INDUSTRIAL APPLICABILITY

The air conditioner of the present invention returns oil pooled in the refrigerant circuit outside of the compressor prior to the refrigerant quantity judging operation and keeps the refrigeration machine oil distribution conditions uniform inside the refrigerant circuit, whereby the detection error caused by the difference in solubility of the refrigerant into the oil can be reduced to the extent possible and highly precise refrigerant quantity judging operation can be carried out. Therefore, the present invention is useful as a refrigerant circuit of an air conditioner, an air conditioner provided therewith, and other air conditioners.

What is claimed is:

1. An air conditioner comprising:

a refrigerant circuit having a heat source unit having a compression mechanism and a heat source side heat exchanger, a refrigerant communication pipe, the heat source unit being connected thereto, an expansion mechanism, and a utilization unit having a utilization side heat exchanger and being connected to the refrigerant communication pipe; and an operation controller being configured to perform an oil-return operation in advance when a refrigerant quantity judging operation is carried out to judge the refrigerant quantity inside the refrigerant circuit.

2. The air conditioner as recited in claim 1, wherein the oil-return operation is an operation for controlling controls the refrigerant that flows through the refrigerant circuit so that the refrigerant flows inside the pipes at or above a prescribed rate.

3. The air conditioner as recited in claim 2, wherein a plurality of the heat source units is present.

4. The air conditioner as recited in claim 3, wherein the compression mechanism has a plurality of compressors.

5. The air conditioner as recited in claim 4, wherein the operation controller operates at least one unit among the plurality of compressors in the compression mechanism when the oil-return operation is performed.

6. The air conditioner as recited in claim 2, wherein the compression mechanism has a plurality of compressors.

7. The air conditioner as recited in claim 6, wherein the operation controller operates at least one unit among the plurality of compressors in the compression mechanism when the oil-return operation is performed.

8. The air conditioner as recited in claim 1, wherein a plurality of the heat source units is present.

9. The air conditioner as recited in claim 8, wherein the compression mechanism has a plurality of compressors.

10. The air conditioner as recited in claim 9, wherein the operation controller operates at least one unit among the plurality of compressors in the compression mechanism when the oil-return operation is performed.

11. The air conditioner as recited in claim 1, wherein the compression mechanism has a plurality of compressors.

12. The air conditioner as recited in claim 11, wherein the operation controller operates at least one unit among the plurality of compressors in the compression mechanism when the oil-return operation is performed.

* * * * *

UNITED STATES PATENT AND TRADEMARK OFFICE

CERTIFICATE OF CORRECTION

PATENT NO. : 7,854,134 B2
APPLICATION NO. : 12/097177
DATED : December 21, 2010
INVENTOR(S) : Tadafumi Nishimura et al.

It is certified that error appears in the above-identified patent and that said Letters Patent is hereby corrected as shown below:

On the Title page change the listing of [87] from

Item "[87] PCT Pub. No.: WO2007/069625
PCT Pub. Date: Dec. 16, 2005"

to

Item -- [87] PCT Pub. No.: WO2007/069625
PCT Pub. Date: Jun. 21, 2007 --

Column 11,
Line 17, Claim 2, "the oil-return operation is an operation for controlling controls" should read
-- the oil-return operation controls --.

Signed and Sealed this
Fourteenth Day of August, 2012

David J. Kappos

David J. Kappos
*Director of the United States Patent and Trademark Office*